US005752156A

United States Patent [19]

Chen et al.

[11] Patent Number: 5,752,156

[45] Date of Patent: May 12, 1998

[54] STABLE FIBER INTERFACES FOR BERYLLIUM MATRIX COMPOSITES

[75] Inventors: Kuo-Chun Chen; Paul W. Trester, both of Encinitas; Khodabakhsh S. Mazdiyasni, Alpine, all of Calif.

[73] Assignee: General Atomics, San Diego, Calif.

[21] Appl. No.: 610,714

[22] Filed: Mar. 4, 1996

[51] Int. Cl.[6] ..... B22F 3/14; B22F 7/04

[52] U.S. Cl. ..... 419/11; 419/14; 419/19; 419/24; 419/48; 419/57

[58] Field of Search ..... 419/10, 11, 17, 419/19, 20, 24, 38, 49, 56, 57, 60, 14, 48

[56] References Cited

U.S. PATENT DOCUMENTS

| | | | |
|---|---|---|---|
| 3,364,975 | 1/1968 | Gruber | 164/55 |
| 3,736,109 | 5/1973 | Darling | 29/195 |
| 4,141,726 | 2/1979 | Yajima et al. | 75/229 |
| 4,314,852 | 2/1982 | Brennan et al. | 501/88 |
| 4,544,610 | 10/1985 | Okamoto et al. | 428/611 |
| 4,839,238 | 6/1989 | Nakatani et al. | 428/614 |
| 4,921,822 | 5/1990 | Luthra | 501/95 |
| 4,962,070 | 10/1990 | Sullivan | 501/95 |
| 4,999,336 | 3/1991 | Nadkarni et al. | 505/1 |
| 5,153,057 | 10/1992 | Corbett et al. | 428/283 |
| 5,154,373 | 10/1992 | Scott | 244/117 |
| 5,304,426 | 4/1994 | Grensing | 428/552 |

OTHER PUBLICATIONS

Peacock et al., "Development of Beryllium–Carbide Fibre Reinforced Beryllium for Fusion Applications", IEEE Meeting, Oct. 1993, 4 pages.

Yuen, "High Conductivity Composites", NASP Contractor Report 1146, vol. 1, Mar. 1993 pp. 3.4–63, 64, 67, 69, 71, 73, 74, 76, 83.

Nieh et al., "Interfacial Reaction Between Carbon and Beryllium", *Scripta Metallurgica*, vol. 20, pp. 87–92, 1986.

*Primary Examiner*—Daniel J. Jenkins

*Attorney, Agent, or Firm*—Fitch, Even, Tabin & Flannery

[57] ABSTRACT

High-temperature-stable, fiber-reinforced beryllium metal matrix composite materials are fabricated using coating, infiltration and hot-pressing procedures. High-temperature-stable fibers of metal oxides, carbon or silicon carbide are coated with reaction barrier coatings which prevent chemical reactions from occurring at the interface with the surrounding metallic beryllium matrix at temperatures up to close to the melting point of beryllium. Coatings such as yttria, YAG and mixtures of yttria and YAG or of yttria and beryllia are employed exterior of metal oxide fibers, such as alumina or alumina-silica fibers. Suitable reaction barrier coatings are also employed over carbon fibers (or silicon carbide fibers) which preferably include an interior coating of elemental silicon upon the exterior surface of the carbon fibers. Oxide coatings are preferably applied by immersion in a liquid bath containing a suitable coating solution, preferably an alcohol solvent alkoxide sol-gel.

19 Claims, No Drawings

STABLE FIBER INTERFACES FOR BERYLLIUM MATRIX COMPOSITES

This invention relates to fiber-reinforced metal matrix composite materials, and more particularly to beryllium matrix, high-temperature-stable composite materials wherein the reinforcing fibers are coated with reaction barrier coatings which provide stable fiber interfaces. This invention also relates to processes for making such metal matrix materials wherein the reinforcing fibers are first coated with appropriate reaction barrier coatings and thereafter beryllium powder is distributed throughout the interstices of arrays of such coated fibers as a part of the formation of a composite.

BACKGROUND OF THE INVENTION

Metallic beryllium has a melting point above 1200° C. and a relatively low density of less than 2 grams per cubic centimeter, and because of its relatively high thermal conductivity, it is an excellent prospect as a structural material for use in lightweight high temperature applications. Unfortunately, metallic beryllium is relatively brittle at low temperatures, and it does not have high mechanical strength, particularly at high temperatures. This limits the use of beryllium in homogenous elemental form; however, it remains an excellent candidate for use as a matrix for composite materials where strength is provided by reinforcing fibers.

U.S. Pat. No. 4,141,726 proposes the making of a beryllium matrix composite material wherein silicon carbide reinforcing fibers are used, stating that there is excellent adherence of beryllium to silicon carbide and that no adverse reaction occurs at the interfaces between the beryllium metal and the silicon carbide. In this patent, it is proposed that a variety of silicon carbide fibers can be directly formed into such beryllium matrix composite materials containing from 5 to 95% by weight of silicon carbide fibers either (a) by simply hanging bundles of such fibers in a crucible which contains molten beryllium metal at about 1300° C. or (b) by imbedding fibers in a packed bed of beryllium metal powder, compacting to create a green pellet, and then sintering at about 1200° C. for 2 hours under an argon atmosphere, or alternatively hot-pressing at 1200° C. for 30 minutes at 200 kg/cm$^2$. It is found however that, although it is possible to form such composites under argon atmospheres at 1200°to 1300° C., these composite materials do not exhibit satisfactory long-term high-strength characteristics. A reaction is found to occur at the interface between the beryllium matrix material and the exterior surfaces of the silicon carbide fibers, which reaction causes degradation of the fiber strength, as a result of which the overall strength and the modulus of elasticity of the composite are significantly reduced.

Accordingly, improved beryllium matrix fiber-reinforced composite materials have continued to be sought, along with processes for making such composite materials.

SUMMARY OF THE INVENTION

It has now been found that improved beryllium metal matrix fiber-reinforced composite materials can be formed, which will retain their structural strength although exposed for prolonged periods to high temperatures, by coating appropriate fibers with certain reaction barrier coatings that form stable interfaces and prevent chemical reactions from occurring during composite processing and at desired service temperatures of about 600°–700° C., as well as during short temperature excursions up to about 1100° C. and above, even approaching the melting point of beryllium, i.e. 1284° C. As a result, beryllium matrix composite materials, reinforced both with metal oxide fibers and with carbon fibers, have been made which exhibit desirable microstructure features of no interaction at the fiber interface. Single layer coatings or multi-layer coatings can be employed on such fibers. Although the coatings are generally tailored to the particular fibers that are being used, generally preferred coatings include at least one layer which contains yttrium oxide. Carbon fibers and silicon carbide fibers may have particular advantages for certain applications and may have coatings that include a layer of elemental silicon; however, from the standpoint of expense and where high thermal conductivity is not considered to be of most importance, oxide fibers, particularly aluminum oxide fibers, which may be coated with yttria or yttrium aluminum garnet(YAG), are considered to be particularly useful for many applications.

Coatings are suitably applied to the fibers which may be in the form of tows of fine microfilaments or in the form of bundles of monofilaments. Coatings can be applied by state-of-the-art coating processes, and if yttria or YAG coatings are used, they are preferably applied from organoyttrium compounds using a sol-gel process, followed by curing and pyrolyzing to create thermodynamically stable coatings. Arrays of such coated fibers are then preferably arranged in a liquid environment, and these fiber arrays are impregnated with beryllium powder by electrophoretic infiltration. Initial sintering of these powder-infiltrated fibrous arrays is carried out at a temperature of at least about 800° C., and such initially sintered arrays are then packed in beryllium powder and subjected to conventional beryllium hot-pressing to form a fully dense, heat-stable composite material.

DETAILED DESCRIPTION OF THE PREFERRED EMBODIMENTS

There are numerous applications for high temperature stable, relatively lightweight composite materials, and reinforced beryllium metal matrix materials made in accordance with the present invention are excellently suited to meet such requirements. Such composite materials which withstand very high service temperatures, for example, above about 1100° C. for short durations, are particularly useful because of their high thermal conductivity and because they will also exhibit a high fracture resistance under thermal pulsing. As a result, these composite materials are advantageously used in fusion reactors as fusion Plasma Facing Components (PFCs).

A variety of high-strength fibers can be used which retain their high-strength at desired service temperatures. For example, fibers are used which retain their tensile strength above about 500° C., preferably above about 700° C., more preferably above about 900° C. and most preferably as high as about 1100° to about 1200° C. Generally, metal oxide fibers, carbon fibers and silicon carbide fibers are preferred. Of the metal oxide fibers, aluminum oxide fibers are most preferred although yttria, YAG and quartz fibers might be used for some applications, as well as alumina-silica fibers containing up to about 20 weight percent of silica. Although relatively short fibers or whiskers can be used, continuous fibers are preferably used. The term "continuous" is generally used to refer to filaments or fibers having a substantial length such that they might be woven into a cloth or other similar structure, if desired, e.g. a length of at least several inches. More preferably fibers with high aspect ratios are used, and most preferably, the fibers have high lengths that are greater than 25,000 times their diameters. Such fibers are commercially available, and these commercially available fibers can be employed either in the form of tows or bundles of monofilaments. For example, Nextel fibers from the 3M Company, which contain a major portion of aluminum oxide, up to about 25 weight % silicon dioxide and some boron oxide, may be used; these fibers are sometimes referred to as aluminumboronsilicate or alumina-boria-silica fibers. Aluminum oxide fibers, such as ALMAX fibers sold by Mitsui Mining Co., as well as other commercially available alumina and alumina-silica fibers, can also be used. There are numerous commercially available carbon fibers, and the high-performance polyacrylonitrile(PAN)-based carbon fibers, which are sold by Hercules and Amoco, are preferred. Silicon carbide fibers are commercially available from Avco, and suitable SiC fibers are available as Nicalon fibers produced by Nippon Carbon Co. An excellent discussion of fibers available for such fiber-reinforced matrixes is found in the text "Fiber Reinforced Ceramic Composites", *NOYES Publications*, Park Ridge, N.J., edited by K. S. Mazdiyasni (1990), the disclosure of which is incorporated herein by reference.

The fibers preferably have a coefficient of thermal expansion(CTE) substantially lower than that of the Be matrix. As a result, the composite matrix will exhibit a modified CTE significantly less than that of Be metal.

Although individual fibers, e.g. monofilaments up to about 125 μm in diameter which are of single crystal alumina material, such as those sold under the name Saphikon, may be employed, preferably multiple-filament tows are employed which are formed of small microfilaments having diameters of about 50 μm or less, e.g., about 10 μm. Examples of fibers which are available in the form of continuous multi-filament tows include alumina ($Al_2O_3$), silica ($SiO_2$), alumina-silica (mulite), titania ($TiO_2$), zirconia ($ZrO_2$), silicon carbide (SiC) and carbon fibers.

The coating of the fibrous materials, which may in the form of multi-filament tows, is carried out in a suitable manner as generally known in this art. For example, coatings can be applied by chemical vapor deposition(CVD) or chemical vapor infiltration(CVI) as discussed in the Mazdiyasni text referenced hereinbefore. Preferably however, the coatings are applied from a fluid media, more preferably from a liquid bath; such bath may include aqueous, nonaqueous and aqueous-organic solutions, as well as aqueous, nonaqueous and aqueousorganic dispersions or suspensions. Most preferably, aqueous, nonaqueous and aqueous-organic sols or sol-gels are used, depending of course upon whether an oxide or some other appropriate coating material is being applied. For example, whereas elemental silicon might be preferably applied through a CVD or a CVI process, a yttria or YAG coating is preferably applied via a sol-gel process.

The reinforcing fibers of choice, i.e. alumina and carbon fibers, are reactive with elemental Be at temperatures of about 600° C. and above. Therefore, the object is to provide single or multiple coatings that will prevent chemical reaction at the fiber-matrix interface at temperatures of at least about 600° C., preferably at least about 700° C., more preferably at about 1100° C. and most preferably at about 1200° C. for short durations, e.g. 30 minutes; such coatings are considered to provide thermodynamically stable Be matrix composites.

Suitable yttria coatings can be applied using yttrium oxide precursors in the form of hydroxides, carbonates, halides, sulfates, nitrates, alkoxides, organometallics or the like. Examples include yttrium hydroxide, yttrium nitrate, yttrium alkoxide, yttrium-aluminum alkoxide, and yttrium-beryllium alkoxide. Generally the concentration of the metal oxide or metal oxide precursor in the fluid medium can vary fairly widely; typically, the concentration will fall in the range of between about 0.005 to about 1 mole per liter.

Nonaqueous solutions contemplated for potential use include solutions of oxides or oxide precursors in alcohols having up to about 10 carbon atoms, hydrocarbon moieties such as saturated hydrocarbons, unsaturated hydrocarbons and aromatics having up to about 10 carbon atoms, aldehydes, ketones, ethers (cyclic or acyclic) and amines having up to about 10 carbon atoms. Generally aqueous organic solutions contemplated for use include solvent mixtures including from about 5 to 95 weight percent of such an organic solvent that is miscible with water.

Such oxide or oxide precursor-containing solutions can generally be converted to a gel by changing the pH of the fluid medium sufficiently to cause gelation thereof. Alternatively, gelation can be promoted by changing the temperature, by adding a non-solvent to the medium, by adding a curing agent, for example, ammonia or urea, to the medium, or by evaporating some of the medium.

Sol-gel solutions are essentially solutions containing a polymeric network of partially hydrolyzed or fully hydrolyzed metal salts, metal alkoxides or other organometallics. Such sol-gel solutions are prepared using procedures well known to those in this art. Particularly suitable metal alkoxides are those containing alkyl groups of up to about 10 carbon atoms, for example, yttrium tri-isopropoxide. Suitable alcohols for forming the above-described sol-gel solutions include alcohols having up to about 10 carbon atoms. Preferably, the alkyl portion of the alcohol will be the same of the alkyl portion of the alkoxide, with ethanol and isopropanol being the generally preferred alcohols.

Contacting of the continuous, multi-filament refractory fiber tows with such a metal oxide or metaloxide precursor-containing liquid medium is preferably carried out for a time sufficient to allow the liquid medium to thoroughly wet substantially all of the fibers in the tow. Examples of such coating of multi-filament tows with liquid alkoxide solutions are disclosed in detail in U.S. Pat. No. 5,316,797, to Hazlebeck et al., the disclosure of which is incorporated herein by reference. Generally, contacting is carried out at a temperature up to about 100° C. for a time of about 0.01 to about 5 minutes so that the liquid medium comes into intimate contact with all of the fibers and forms a substantially continuous film on the surface of each of the individual fibers. Individual tows may be coated, or tows that have been woven into fabric or cloth may be coated in that form.

The thickness of the reaction barrier coating should be sufficient so that it will insure complete coverage of the entire length of the fiber and so that it will assure stability throughout both the composite processing steps and the service life of the composite material. Generally, for multiple-filament tows made of individual filaments about 10 μm in fiber diameter, the thickness of the overall coating should be between about 0.3 μm and about 3 μm. Preferably, the coating thickness is at least 0.5 μm, and most preferably it is at least about 1 μm thick. For coating larger diameter fibers or filaments, coating thicknesses up to 10 μm might be used.

Depending upon the thickness of the coating, it may be applied in a single pass through a liquid coating bath or the like. Of course, if it is applied by CVD or the like, it would generally be applied in a single application when a homogeneous coating is being used. Thicker coatings, and of course multiple coatings made up of layers of different materials, are applied by multiple passes through coating baths, as taught in the '797 patent. Generally, the composition of the bath will determine the thickness of the coating that will be applied in a single pass, and usually multiple passes will be used to apply coatings of desired thickness to the individual filaments in a multi-filament tow.

For aluminum oxide fiber tows or alumina filaments in bundles, as well as for panels of woven fabric made from the foregoing, the preferred reaction barrier coatings are those either of yttria or of a multi-layer coating of yttria and YAG. When carbon fibers or silicon carbide fibers are employed, a layer of elemental silicon may be used as a reaction barrier coating that is in direct contact with exterior fiber surface. Such an elemental silicon layer may be expediently deposited by CVD. It may be between about 0.25 μm and 0.5 μm in thickness; preferably, a layer between about 0.3 μm and about 0.5 μm thick is used. As an alternative to such an elemental silicon layer for carbon or SiC fibers, or in combination with and located exterior of such an elemental silicon layer, a yttria layer may be employed. Such a yttria layer, if used by itself or if used in combination with an elemental silicon layer, would preferably have a thickness of between about 0.3 μm and about 2 μm.

Alternatively for carbon fibers, an intermediate layer of silicon carbide may be employed between such carbon fibers and the yttria layer; in such case, a silicon carbide layer could be deposited either by CVD or by coating with an organic precursor, such as a polycarbosilane, which is then pyrolyzed. In such case, the intermediate layer of silicon carbide would preferably be between about 0.3 μm and about 1 μm in thickness.

As previously mentioned, instead of using yttria by itself as a coating, a YAG coating could be employed, or a coating with a mixture of yttria and beryllia could be employed. If such a beryllia-yttria mixture is used, the proportions are usually such that the atoms of Be are equal to between about 0.5 and about 1.5 times the atoms of Y, and it is used at about the same thickness as a yttria coating. If such is used as the exterior layer of a multi-layer coating with an inner layer of $Y_2O_3$, its thickness might be between about 0.3 μm.

Once the coatings have been applied and calcined or otherwise pyrolyzed so as to create hard, strong, continuous layers that provide an adequate reaction barrier, the fibers are ready for incorporation into the beryllium metal matrix. The coated fibers are preferably arranged in the form of a suitable array, and such arrangement is facilitated when the coated fibers are already in fabric form. Otherwise, the fibers are simply arranged in a suitable architecture as desired for the resultant composite material, using an appropriate fixture to clamp or otherwise support the fibers in such desired regular alignment. For example, a plurality of parallel panels of fabric or a plurality of parallel strands of coated fabric tows can be arranged in an architecture as desired for the resultant metal matrix composite.

This fiber array is then impregnated with beryllium powder, and preferably the technique of electrophoretic particle infiltration is used. The details of electrophoretic infiltration are described in U.S. Pat. No. 5,468,358, issued Nov. 21, 1995, the disclosure of which is incorporated herein by reference. Very briefly, the fiber array is supported in a liquid slurry at a location near the anode; the slurry includes beryllium powder having a particle size less than about 10 μm dispersed in an aprotic solvent at about 20° C. An electric field is created within the slurry by applying a voltage between the anode and a cathode which is spaced therefrom, so that the charged beryllium particles attempt to migrate through the fiber array to the surface of the anode, as a result of which they become trapped within and fill the interstices of the fiber tows. When the beryllium metal powder deposition front has progressed such that the entire array is filled with a particulate beryllium powder so as to form a composite preform, the infiltration process is considered to be completed, and the particle-impregnated array is removed from the slurry and dried. Van der Waal forces hold adjacent Be particles together as a part of the fragile composite preform. Sufficient Be particles should be impregnated into the fiber array so that, following sintering, the resultant preform is at least about 40% dense.

Subsequently, an initial sintering process is carried out by raising the coated fiber preform to the sintering temperature of beryllium, preferably to a temperature of at least 800° C. in an atmosphere having a low oxidizing potential. Sintering is preferably carried out in an inert gas atmosphere, e.g. argon or helium, which may include a minor percentage of hydrogen, and for a time sufficient to create a structurally stable preform. For example, prior to hot isostatic pressing, the matrix can be strengthened by sintering at about 900° C. in an atmosphere containing about 90% argon and 10% hydrogen for about 2 hours to produce a preform wherein at least about 40% or more of its volume is occupied by solids.

The preform structure is then packed within surrounding fine beryllium powder, and a vacuum is applied to the preform and the surrounding fine beryllium powder which are contained in a flexible metal container or pouch which encompasses the arrangement. Once the atmosphere is exhausted, the arrangement is subjected to hot isostatic pressing for a suitable time and temperature; such is preferably carried out at about 1000° C. and at least about 1.5 MPa (217 psig) for about 2 hours. The resulting product is found to be fully dense and is structurally strong. The hot isostatic pressing (HIP) causes the fine powder to fill the pores of the preform while the architecture of the fiber tows in the preform is preserved. By fully dense, it is meant that the coated fiber-Be matrix composite is at least about 95% of theoretical density, which is a summation of the fiber density and the matrix density. The resulting product can be suitably machined and/or etched to a final design size and shape, as desired.

The following examples disclose representative methods for providing beryllium metal matrix, fiber-reinforced composites which disclose the best modes presently known to the inventors for carrying out their invention. However, it should be understood that these examples are for purposes of illustration and do not constitute limitations upon the scope of the invention which is defined by the claims at the end of the specification.

EXAMPLE 1

Panels of woven fabric which is formed from multifilament alumina fiber tows containing about 1000 filaments per tow, each having a diameter of about 10 μm, are provided. The panels are each about 26 millimeters by 31 millimeters having a simple weave pattern. Such fabric is sold under the trademark ALMAX by Mitsui Mining Co., Ltd. and is 99.5% $Al_2O_3$. The filaments of the fabric panels are first coated with appropriate coatings of yttria. A coating bath is used having a concentration which is 0.15 molar yttrium tri-isopropoxide in a solution of isopropyl alcohol. Coating is carried out by immersing the fabric in the coating solution for about 1 minute, and curing is then carried out by exposure to steam vapor for about 3 minutes. The cured fabric is dried at about 150° C. for about 3 minutes and then calcined at about 800°C. for about 30 minutes. The $Y_2O_3$ coating is determined to be about 0.2 μm thick. The coating process is then repeated 5 times to obtain a total thickness of about 1 μm. After each coating dip, curing with steam vapor and drying takes place, and after every 2 coating dips and at the end, a calcining step is carried out.

Six plies of the coated alumina fabric are arranged in a nylon jig which is supported in a receptacle between 2 electrodes at a location adjacent the anode. The receptacle is then hung in a polypropylene container which is filled with a bath which is a slurry of Brush I400 beryllium powder having a very small particle size between about 1 μm and about 10 μm in a suspending liquid of acetone; an appropriate amount of a surfactant, tetramethyl ammonium stearate (TMAS) is included to assure the beryllium powder develops a surface charge in the suspension. Voltage applied across the electrodes is increased incrementally to about 300 volts (between about 2 –5 milliamps). After about 15 minutes total time, infiltration of the lay-up, which is about 6 mm in thickness, is considered to be complete. The voltage is removed, and the fiber array is removed from the bath and separated from the anode.

The beryllium-impregnated fabric lay-up is dried to provide a solid preform and then sintered in a argon atmosphere containing about 10% hydrogen for about 3 hours at a temperature of about 900° C. to create a preform having dimensional stability. This sintering bonds the Be metal matrix particles to one another and provides low structural strength for the preform which is of high porosity being only about 40% dense. The preform is then packed in a bed of fine beryllium powder in a flexible metal surrounding can. Following an initial application of vacuum, it is subjected to hot isostatic pressing at a temperature of about 1000° C. for about 2 hours at a pressure of about 1.5 MPa. Upon completion, it is separated from the encapsulation can and machined to the desired size and shape. The composite has a thickness of about 6 millimeters, and it appears to be of uniform density and to have good structural strength.

Evaluation is carried out by sawing through the composite to create several pieces which are mounted in epoxy for grinding and polishing. The fiber-reinforced composite retains its integrity during sawing as a result of its inherent structural strength. Examination by scanning electron microscopy (SEM) and optical microscopy are carried out to observe the interface between the beryllium matrix and the fibers. The examination shows that the fiber phase and the matrix phase remain discrete and that there is no chemical interaction between them which is evidence of the thermodynamic stability of the composite material. The fibers are found not to be degraded even though exposed to high temperature for the extended period of time during initial sintering and then HIP. The Be powder particles are observed to have consolidated, and no void zones are observed.

EXAMPLE 2

The procedure of Example 1 is repeated using a coating bath which is a mixture of an organoaluminum compound and an organoyttrium compound. The compounds used are aluminum isopropoxide and yttrium isopropoxide in a stoichiometric ratio of about 3 atoms of yttrium to 5 atoms of aluminum. As a result, the material coated is a mixture of yttria and YAG. Coating is carried out as described hereinbefore by immersing the fabric panels in the alkoxide alcohol solution, and a continuous coating about 0.3–0.5 μm thick of the mixture of metal oxides is deposited upon the individual filaments in each tow. Again 6 plies are used to create the lay-up within the nylon clamping fixture, and electrophoretic impregnation with beryllium metal powder is carried out as described in Example 1, followed by drying and sintering for 2 hours at 900° C. The preform which results is then packed in fine beryllium metal powder and subjected to hot isostatic pressing as described hereinbefore. Thereafter, it is similarly sawed, and sections are mounted for examination as described in Example 1. The fiber-reinforced composite retains its structural strength, and examination by scanning electron microscopy (SEM) and optical microscopy shows that it is fully dense, that the fibers phase and the matrix phase remain discrete and that no chemical interaction occurs. The fibers do not suffer degradation as a result of subjection to high temperature during processing to create the composite.

EXAMPLE 3

Alumina monofilament having a diameter of about 125 μm, which is commercially available from Saphikon Co. and sold under the trade name Saphikon, is coated using the coating bath and the coating procedure of Example 2 to produce, following curing and calcining, a $Y_2O_3$-YAG coating about 1 μm thick. A lay-up is created using one fabric panel coated as described in Example 2 together with 3 plies of bundles of monofilaments laid parallel to one another, with each ply having an orientation in a different direction. The lay-up is subjected to electrophoretic impregnation as in Examples 1 and 2, followed by sintering for 2 hours at 900° C. Hot isostatic pressing of the preform in a surrounding bed of beryllium metal powder is carried out, followed by cross sectioning and examination as in the previous examples. The results show that the fiber-reinforced composite retains its structural strength, and SEM examination of the interface between the beryllium matrix and the fibers shows that the fiber phase and the matrix phase remain discrete so that the system is shown to be thermodynamically stable. The fibers suffer no degradation as a result of high temperature exposure during processing and should retain their inherent tensile strength.

EXAMPLE 4

The procedure of Example 1 is repeated except the lay-up is made with only 3 fabric layers instead of 6. As a result, electrophoretic infiltration at the voltage of about 300V for about 10 minutes, instead of 13 –15 minutes, is sufficient to accomplish the desired impregnation of beryllium metal powder throughout the interstices of the 3-ply fabric lay-up, which has a thickness of about 4–5 mm. Sintering, hot isostatic pressing and examination are then carried out as in Example 1. The results show that the fiber-reinforced composite retains its structural strength. SEM examination of the interface between the beryllium matrix and the fibers shows that the fiber phase and the matrix phase remain discrete and that the fibers suffer no degradation as a result of high temperature exposure during composite fabrication.

EXAMPLE 5

The fabric coating process as described in Example 1 is repeated to coat 4 fabric layers with yttria coatings. The 4 fabric layers are held in the nylon clamping arrangement and infiltrated using electrophoretic infiltration for about 12 minutes. After drying, sintering is carried out for about 3 hours in the argon-hydrogen atmosphere. Thereafter, hot isostatic pressing as described in the foregoing examples is carried out, followed by cross sectioning and examination. The results show that the fiber-reinforced composite retains its structural strength, and SEM examination of the interface between the beryllium matrix and the fibers shows that the fiber phase and the matrix phase remain discrete and that the fibers suffer no degradation as a result of high temperature exposure.

EXAMPLE 6

To demonstrate the suitability of carbon fiber reinforcement, tows of Amoco P-120 PAN carbon fibers are used in the form of tows containing about 2,000 fibers, which are individually about 10 μm in diameter. The carbon fiber tows are immersed 3 separate times in the yttrium isopropoxide coating bath described in Example 1, and calcining is carried out after the first 2 coatings and following the third coating. Following the coating and calcining, the yttria-coated carbon fiber tow is subjected to heating in a gas mixture of 90% argon, 9.5% nitrogen and 0.5% oxygen at a temperature of about 600° C. for 5 minutes. Following this treatment, microscopic examination is carried out, and it is found that the individual filaments in the tows have a yttria coating of at least about 0.2 μm thick. A plurality of the coated carbon fiber tows are aligned side-by-side and surrounded in a bed of fine beryllium powder and are then subjected to hot isostatic pressing in a soft steel container as described in Example 1. They are thereafter cross sectioned and examined. SEM examination of the interface between the beryllium matrix material and the fibers shows that the fiber phase and the matrix phase remain discrete. The fibers do not appear to degrade as a result of high temperature exposure during calcining and HIP and appear to retain their inherent tensile strength.

The above procedure is repeated except that, instead of using 3 immersions in the coating bath, the carbon fiber tows are immersed 4 separate times. Calcining and heat treatment is carried out as described above, and microscopic examination shows that the resultant individual carbon fiber microfilaments have a coating of at least about 0.23 μm of yttria. HIP is carried out as described above, and the fiber tow Be-matrix composite material is shown to be fully acceptable with no degradation apparent as a result of high temperature exposure.

The above procedure is repeated once more, this time immersing the carbon fiber tows in the coating bath for 6 separate alternating immersions and steam treatments, with calcining being carried out after each second steam treatment. The remainder of the procedure is as described above. Microscopic examination of the cross-sectioned fiber-beryllium composite shows that the fiber phase and the matrix phase remain discrete at the interface between the beryllium matrix and the fibers. The fibers show no degradation as a result of high temperature exposure and appear to retain their inherent tensile strength.

EXAMPLE 7

Carbon fiber tows as used in Example 6 are coated first with a coating of silicon carbide by immersing the panels in an organic solution sold by Union Carbide under the tradename Y-12044 which contains a polycarbosilane. After each immersion, the coating is cured at a temperature of about 200° C. and then pyrolyzed at a temperature of about 600°–800° C. for 5–10 minutes in an atmosphere of 0.5% $O_2$+9.5% $N_2$+90% Ar (vol. %). This coating step is repeated 3 times, and after the third coating has been pyrolyzed, microscopic examination shows that a coating of silicon carbide having a thickness of about 0.5 μm or slightly greater has been deposited upon each of the carbon filaments. Thereafter, the SiC-coated carbon fiber tow is treated as in Example 6 so as to apply 4 coats of yttria using the above-described yttrium isopropoxide coating bath. Treatment is carried out as described above, followed by hot isostatic pressing. Following cross sectioning and mounting, SEM examination of the interface between the beryllium matrix and the fibers shows that the fiber phase and the matrix phase remain discrete. The system is thermodynamically stable, and the fibers shows no degradation as a result of high temperature exposure and appear to retain their inherent tensile strength.

The procedure described above is repeated except that only 2 coatings of polycarbosilane are used so as to create a coating of silicon carbide that is at least about 0.3 μm thick on the carbon microfilaments. This is followed by 4 coatings using the yttrium isopropoxide bath and results in an exterior layer of yttria having a thickness of about 0.1 to 0.5 μm. Heat treatment and HIP are carried out as described above. Following cross-sectioning and mounting, SEM examination of the interface between the beryllium matrix and the fibers shows that the fiber phase and the matrix phase remain discrete. The system is thermodynamically stable, and the fibers show no degradation as a result of high temperature exposure and appear to retain their inherent tensile strength.

EXAMPLE 8

The procedure set forth in the final paragraph of Example 7 is repeated to deposit 2 layers of silicon carbide and 4 layers of yttria. Thereafter, the dual-layer coated tow is immersed in a coating bath containing beryllium isopropoxide and yttrium isopropoxide in a ratio of about an equal number of atoms of beryllium to yttrium. Following immersion, curing is carried out by exposure to steam for about 3 minutes, followed by drying at about 150° C. and then calcining at about 800° C. for 30 minutes. The process is repeated twice to thicken the layer of a mixture of beryllia and yttria, and microscopic examination shows that the carbon microfilaments are coated with a third layer, exterior of the pure yttria layer, which has a thickness of about 0.3 to 0.5 μm. Heat treatment and HIP are carried out as described in Example 7. Following cross-sectioning and mounting, SEM examination of the interface between the beryllium matrix and the fibers shows that the fiber phase and the matrix phase remain discrete. The system is thermodynamically stable, and the fibers show no degradation as a result of high temperature exposure and appear to retain their inherent tensile strength.

EXAMPLE 9

Amoco P-120-type carbon fiber tows, as described in Example 6, are coated with elemental silicon by CVD coating. Microscopic examination shows that the thickness of the elemental silicon layer is about 0.1 to 0.3 μm, is continuous and completely covers the carbon microfilaments. A plurality of such silicon-coated carbon fiber tows are aligned side-by-side and embedded in a surrounding bed of fine beryllium powder and then subjected to HIP, as described hereinbefore. The resultant product is cross sectioned and examined as described above. SEM examination of the interface between the beryllium matrix and the fibers shows that the fiber phase and the matrix phase remain discrete. The system is thermodynamically stable, and the fibers show no degradation as a result of high temperature exposure and appear to retain their inherent tensile strength.

EXAMPLE 10

The procedure of Example 9 is repeated to create an initial coating of elemental silicon on the carbon microfilaments. Thereafter, the coated carbon fiber tows are subjected to immersion in a coating bath of yttrium isopropoxide as described in Example 6; 4 immersions are carried out. Following heat treatment as described in Example 6, the carbon microfilaments are shown to have a yttria coating thickness of about 0.2 to 0.5 μm exterior of the elemental silicon. Heat treatment and HIP are then carried out as described in Example 6. SEM examination of the interface between the beryllium matrix and the fibers shows that the fiber phase and the matrix phase remain discrete. The system is thermodynamically stable, and the fibers show no degradation as a result of high temperature exposure and appear to retain their inherent tensile strength.

EXAMPLE 11

The procedure of Example 10 is repeated except that, instead of using the yttrium alkoxide coating bath, the beryllium isopropoxide-yttrium isopropoxide coating solution described in Example 8 is used. Two immersions are employed, and following heat treatment as described hereinbefore, microscopic examination shows that the silicon-coated microfilaments have an exterior layer of beryllia-yttria about 0.2 to 0.5 μm in thickness. Heat treatment and HIP are carried out as described hereinbefore, and the samples are cross sectioned and examined as before. SEM examination of the interface between the beryllium matrix and the fibers shows that the fiber phase and the matrix phase remain discrete. The system is thermodynamically stable, and the fibers show no degradation as a result of high temperature exposure and appear to retain their inherent tensile strength.

EXAMPLE 12

The procedure of Example 6 is repeated except that, instead of using tows of Amoco PAN carbon fibers, silicon carbide fiber fabric sold by Nippon Carbon is used that is woven using Nicalon brand fiber tows containing multiple microfilaments of silicon carbide. Treatment is carried out as described in Example 6 to apply 4 separate coats of yttria using the yttrium isopropoxide coating bath. The remainder of the procedure as set forth in Example 1 is duplicated through the HIP step, and cross sectioning and examination of the resultant product is similarly carried out. The fiber-reinforced composite retains its structural strength, and SEM examination of the interface between the beryllium matrix and the fibers shows that the fiber phase and the matrix phase remain discrete. The system is thermodynamically stable, and the fibers show no degradation as a result of high temperature exposure and appear to retain their inherent tensile strength.

As a result of the foregoing examples, it can be seen that the invention provides processes for fabricating strong, fiber-reinforced, beryllium metal matrix composites using fibers of metal oxide, such as alumina, carbon fibers or silicon carbide fibers by negating interaction between the fiber material and the Be matrix during high temperature processing. These composites are considered to be thermodynamically stable and thus admirably well suited for use at service temperatures in the range of 600°0C. to 700° C. for indefinite periods of time. Likewise, brief temperature excursions to as high as about 1100° C. or even 1200° C. for short periods of time can be experienced without the occurrence of significant degradation as a result of interaction across the interface. Accordingly, these improved beryllium metal matrix composites show substantial promise for employment as structural materials in constructing high temperature components for use in fusion reactors and in other situations of low oxidizing environment, such as aerospace, where the characteristics of light weight, high stiffness, high strength and resistance to high temperatures and a CTE substantially lower than that of Be are of importance.

Although the invention has been described with regard to certain preferred embodiments, which constitute the best mode as presently known to the inventors, it should be understood that various changes and modifications as would be obvious to one having the ordinary skill in this art may be made without departing from the scope of the invention which is described in the claims appended hereto. For example, instead of using substantially pure alumina fibers, fibers having up to about 20% silica can be employed. Particular features of the invention are emphasized in the claims which follow.

What is claimed is:

1. A process for making fiber-reinforced beryllium metal matrix composites, which process comprises coating reinforcing fibers of metal oxide, carbon or silicon carbide with thermodynamically stable continuous coatings by, forming (a) a homogenous alcohol solution of an organoyttrium compound or (b) a mixture of an organoaluminum compound and an organoyttrium compound having a stoichiometric ratio of about 3 atoms of yttrium to each 5 atoms of aluminum, adding water thereto and causing said solution or said liquid mixture to undergo hydrolytic condensation and polymerization to form a sol-gel, coating said reinforcing fibers with said sol-gel, and heating said coated fibers at a temperature to cure and pyrolyze said sol-gel to create thermodynamically stable coatings thereupon, surrounding said coated fibers with beryllium metal powder, and heating said coated fibers and surrounding beryllium powder under pressure in the absence of gaseous oxygen to form a thermodynamically stable beryllium metal matrix, fiber-reinforced composite material.

2. The process according to claim 1 wherein said fibers are aluminum oxide fibers.

3. The process according to claim 1 wherein said fibers are carbon fibers which are first immersed in an organic solution containing a polycarbosilane and then pyrolyzed to create an undercoating of silicon carbide prior to coating with said sol-gel which comprises a yttrium isopropoxide sol-gel.

4. The process according to claim 1 wherein said coated fibers are disposed in tows or in bundles of monofilaments to create a fiber array between a pair of electrodes in a liquid environment where beryllium metal powder having a particle size between about 1μm and about 10μm is suspended and wherein the application of voltage to said electrodes causes migration of said beryllium metal powder into said fiber array impregnating said fiber array by electrophoretic infiltration.

5. The process according to claim 4 wherein said impregnated array of fibers is sintered by heating in an atmosphere having a low oxidizing potential to a temperature of at least about 800° C. for at least about 5 minutes to create a preform that is at least about 40% dense.

6. The process according to claim 5 wherein said reinforcing fibers are aligned with a desired reinforcing orientation in said fiber array that is impregnated and wherein said sintered array is packed in additional beryllium metal powder and subjected to hot pressing to form a fully dense, heat-stable metallic beryllium matrix composite in which said fiber array is reinforcingly oriented.

7. The process according to claim 6 wherein said hot pressing is hot isostatic pressing and is carried out at a temperature of about 700° C. to 1000° C.

8. A process for making a fiber-reinforced beryllium metal matrix composite, which process comprises coating tows of reinforcing metal oxide fibers with thermodynamically stable continuous coatings by, forming a homogenous alcohol solution containing an organoyttrium compound, adding water thereto and causing said solution to undergo hydrolytic condensation and polymerization to form a sol-gel, coating said reinforcing fibers with said sol-gel, and heating said coated fibers at a temperature to cure and pyrolyze said sol-gel to create thermodynamically stable coatings thereupon, disposing said tows of coated fibers so as to create a fiber array located between an anode and a cathode in a liquid environment where beryllium metal powder having a particle size between about 1μm and about 10μm is suspended, impregnating said fiber array by electrophoretic infiltration in said liquid environment by applying a voltage between said anode and cathode which causes said metal powder to attempt to migrate to said anode, surrounding said impregnated array of coated fibers with additional beryllium metal powder, and heating said coated fiber array and said additional surrounding beryllium powder under pressure in the absence of gaseous oxygen to form a thermodynamically stable beryllium metal matrix, fiber-reinforced composite material.

9. The process according to claim 8 wherein said fibers are aluminum oxide fibers.

10. The process according to claim 9 wherein said solution contains (a) a mixture of an organoaluminum compound and an organoyttrium compound having a stoichiometric ratio of about 3 atoms of yttrium to each 5 atoms of aluminum, or (b) a mixture of an organoberyllium compound and an organoyttrium compound.

11. The process according to claim 8 wherein said thermodynamically stable coatings have a thickness of about 1μm to 3μm.

12. The process according to claim 8 wherein said impregnated array of fibers is sintered by heating in an atmosphere having a low oxidizing potential to a temperature of at least about 800° C. for at least about 5 minutes to create a preform that is at least about 40% dense prior to said surrounding with additional beryllium metal powder.

13. The process according to claim 12 wherein said tows of reinforcing fibers are aligned transversely to one another as a woven fabric panel in said fiber array that is impregnated and wherein said sintered array is packed in said additional beryllium powder and subjected to hot pressing at a temperature of about 700° C. to 1000° C. to form a fully dense, heat-stable metal matrix composite in which said fiber array is reinforcingly oriented.

14. A process for making a fiber-reinforced beryllium metal matrix composite that will exhibit high fracture resistance under thermal pulsing and thus be useful as a fusion Plasma Facing Component, which process comprises coating woven panels of reinforcing fibers of metal oxide, carbon or silicon carbide with thermodynamically stable continuous coatings by, forming an alcohol solution of (a) an organoyttrium compound, or (b) a mixture of an organoaluminum compound and an organoyttrium compound having a stoichiometric ratio of about 3 atoms of yttrium to each 5 atoms of aluminum, or (c) a mixture of an organoberyllium compound and an organoyttrium compound, adding water thereto and causing said solution to undergo hydrolytic condensation and polymerization to form a sol-gel, coating said reinforcing fibers in said woven panels with said sol-gel, and heating said woven panels at a temperature to cure and pyrolyze said sol-gel to create thermodynamically stable coatings upon said fibers, surrounding a plurality of said coated woven panels with beryllium metal powder, and heating said coated fibers and surrounding beryllium powder under pressure in the absence of gaseous oxygen to form a thermodynamically stable, fracture-resistant beryllium matrix, fiber-reinforced composite material.

15. The process according to claim 14 wherein said fibers are aluminum oxide fibers or carbon fibers or silicon carbide fibers.

16. The process according to claim 14 wherein said fibers are aluminum oxide fibers and wherein said coatings comprise YAG.

17. The process according to claim 14 wherein a plurality of said woven panels of coated fibers are disposed between a pair of electrodes in a liquid environment with beryllium metal powder having a particle size between about 1μm and about 10μm suspended in said liquid environment and wherein the application of voltage to said electrodes causes said beryllium metal powder to migrate toward the anode impregnating said woven panels by electrophoretic infiltration.

18. The process according to claim 17 wherein said plurality of impregnated woven panels of coated fibers are sintered by heating in an atmosphere having a low oxidizing potential to a temperature of at least about 800° C. for at least about 5 minutes to create a preform that is at least about 40% dense.

19. The process according to claim 18 wherein said plurality of sintered panels are packed in additional beryllium powder and subjected to isostatic hot pressing at a temperature between about 700° C. and about 1000° C. to form a fully dense, heat-stable metal matrix composite.

* * * * *